US011364614B2

(12) United States Patent
Huang

(10) Patent No.: US 11,364,614 B2
(45) Date of Patent: Jun. 21, 2022

(54) PNEUMATIC TOOL

(71) Applicant: BASSO INDUSTRY CORP., Taichung (TW)

(72) Inventor: Chi-Yung Huang, Taichung (TW)

(73) Assignee: Basso Industry Corp., Taichung (TW)

( * ) Notice: Subject to any disclaimer, the term of this patent is extended or adjusted under 35 U.S.C. 154(b) by 81 days.

(21) Appl. No.: 16/848,522

(22) Filed: Apr. 14, 2020

(65) Prior Publication Data

US 2020/0331137 A1 Oct. 22, 2020

(30) Foreign Application Priority Data

Apr. 16, 2019 (TW) ..... 108204618

(51) Int. Cl.
*B25F 5/00* (2006.01)
*B25F 5/02* (2006.01)
*B25B 21/00* (2006.01)

(52) U.S. Cl.
CPC ..... *B25F 5/001* (2013.01); *B25F 5/02* (2013.01); *B25B 21/00* (2013.01)

(58) Field of Classification Search
CPC ..... B25F 5/02; B25F 5/001; B25B 21/00
See application file for complete search history.

(56) References Cited

U.S. PATENT DOCUMENTS 3,326,240 A * 6/1967 McConnaughay ..... B25B 21/00 137/637.4
7,140,179 B2 * 11/2006 Bass ..... B25F 5/00 60/493
7,537,027 B2 * 5/2009 Bass ..... F16K 11/105 137/625.5
2008/0264662 A1 * 10/2008 Chang ..... B25F 5/00 173/177
2014/0231111 A1 8/2014 Lehnert et al.

FOREIGN PATENT DOCUMENTS

TW M414304 U 10/2011

OTHER PUBLICATIONS

Search Report issued to European counterpart application No. 20169651.5 by the EPO dated Sep. 7, 2020.

* cited by examiner

*Primary Examiner* — Anna K Kinsaul
*Assistant Examiner* — Daniel Jeremy Leeds
(74) *Attorney, Agent, or Firm* — Burris Law, PLLC

(57) ABSTRACT

A pneumatic tool includes a casing unit, an air motor, a rotary valve, and a turning unit. The rotary valve is rotatably mounted to the air motor. The turning unit is movably mounted to the casing unit, and is connected to the rotary valve such that movement of the turning unit relative to the casing unit drives rotation of the rotary valve relative to the air motor to one of a first-end position, a second-end position and at least one in-between position, in which an opening of the rotary valve is in spatial communication with a respective one of a first passage, a second passage and at least one sub-passage for adjusting airflow that travels from an air inlet passage of the casing unit, through the rotary valve, and into the air motor.

10 Claims, 12 Drawing Sheets

PNEUMATIC TOOL

CROSS-REFERENCE TO RELATED APPLICATION

This application claims priority of Taiwanese Patent Application No. 108204618, filed on Apr. 16, 2019.

FIELD

The disclosure relates to a pneumatic tool, and more particularly to a pneumatic tool having an adjustable power output.

BACKGROUND

A conventional pneumatic tool disclosed in Taiwanese Utility Model Patent No. M414304 includes a casing, an air motor, a rotary valve and a switching device.

The air motor is mounted in the casing, and includes a cylinder and a rotor that is rotatably mounted in the cylinder. The cylinder has two inlet air passages. The rotary valve is mounted in the casing, and includes a valve tube for guiding air into the cylinder via one of the inlet air passages. The switching device is arc-shaped and is slidably mounted to the casing for driving the valve tube to rotate. In virtue of the rotation of the valve tube, the valve tube is able to guide the air through either one of the inlet air passages and into the cylinder of the air motor, thereby changing a rotating direction of the rotor.

However, such conventional pneumatic tool can only control the rotating direction of the rotor, that is, the direction of the power output, by allowing the air to travel through either one of the inlet air passages. It is not capable of controlling the flow rate of the air, which means the magnitude of the power output is not adjustable to meet different requirements.

SUMMARY

Therefore, the object of the disclosure is to provide a pneumatic tool that can alleviate the drawback of the prior art.

According to the disclosure, a pneumatic tool includes a casing unit, an air motor, a rotary valve and a turning unit.

The casing unit has an air inlet passage. The air motor is mounted in the casing unit, and includes a cylinder wall that surrounds a motor axis and that defines an air chamber.

The cylinder wall has first and second passages and at least one sub-passage. The first and second passages are in spatial communication with the air chamber. Each of the first and second passages has an open end formed at an outer surface of the cylinder wall. The at least one sub-passage is spatially connected to one of the first and second passages, is isolated from the other one of the first and second passages, and has an open end formed at the outer surface of the cylinder wall between the open ends of the first and second passages. The open end of the at least one sub-passage is smaller than the open end of the one of the first and second passages.

The rotary valve is mounted to the air motor and is rotatable about a valve axis. The rotary valve has an opening, and an intermediate passage that intercommunicates the opening with the air inlet passage of the casing unit.

The turning unit is movably mounted to the casing unit and is connected to the rotary valve, such that movement of the turning unit relative to the casing unit drives the rotary valve to rotate about the valve axis relative to the air motor among a first-end position, a second-end position and at least one in-between position.

When the rotary valve is at the first-end position, the opening is in spatial communication with the first passage, so that air traveling through the air inlet passage of the casing unit is allowed to flow into the air chamber of the air motor for driving operation of the air motor.

When the rotary valve is at the second-end position, the opening is in spatial communication with the second passage.

When the rotary valve is at the at least one in-between position, the opening is in spatial communication with the at least one sub-passage.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
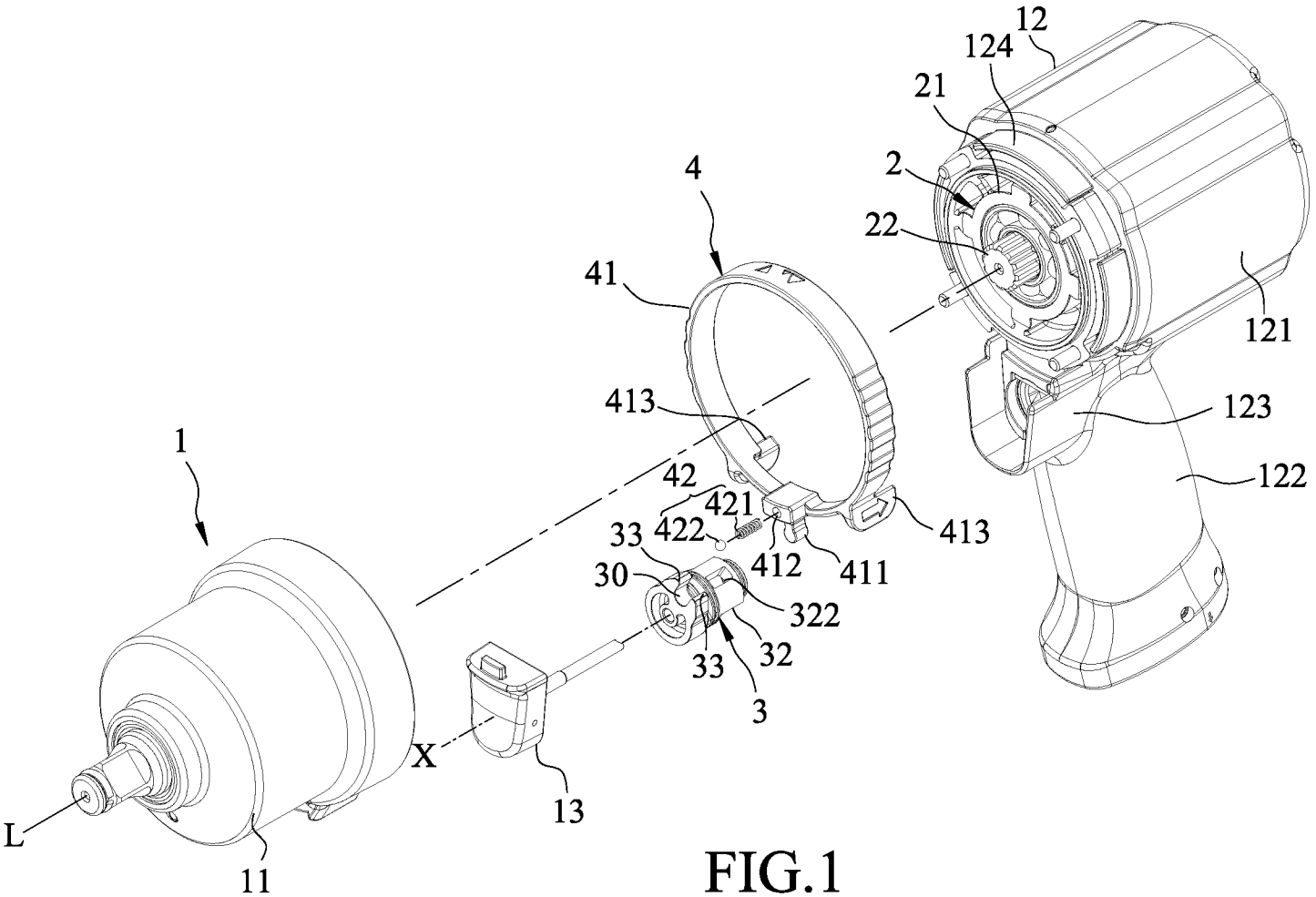
FIG. 1 is a partially exploded perspective view of an embodiment of a pneumatic tool according to the disclosure.
Figure 2:
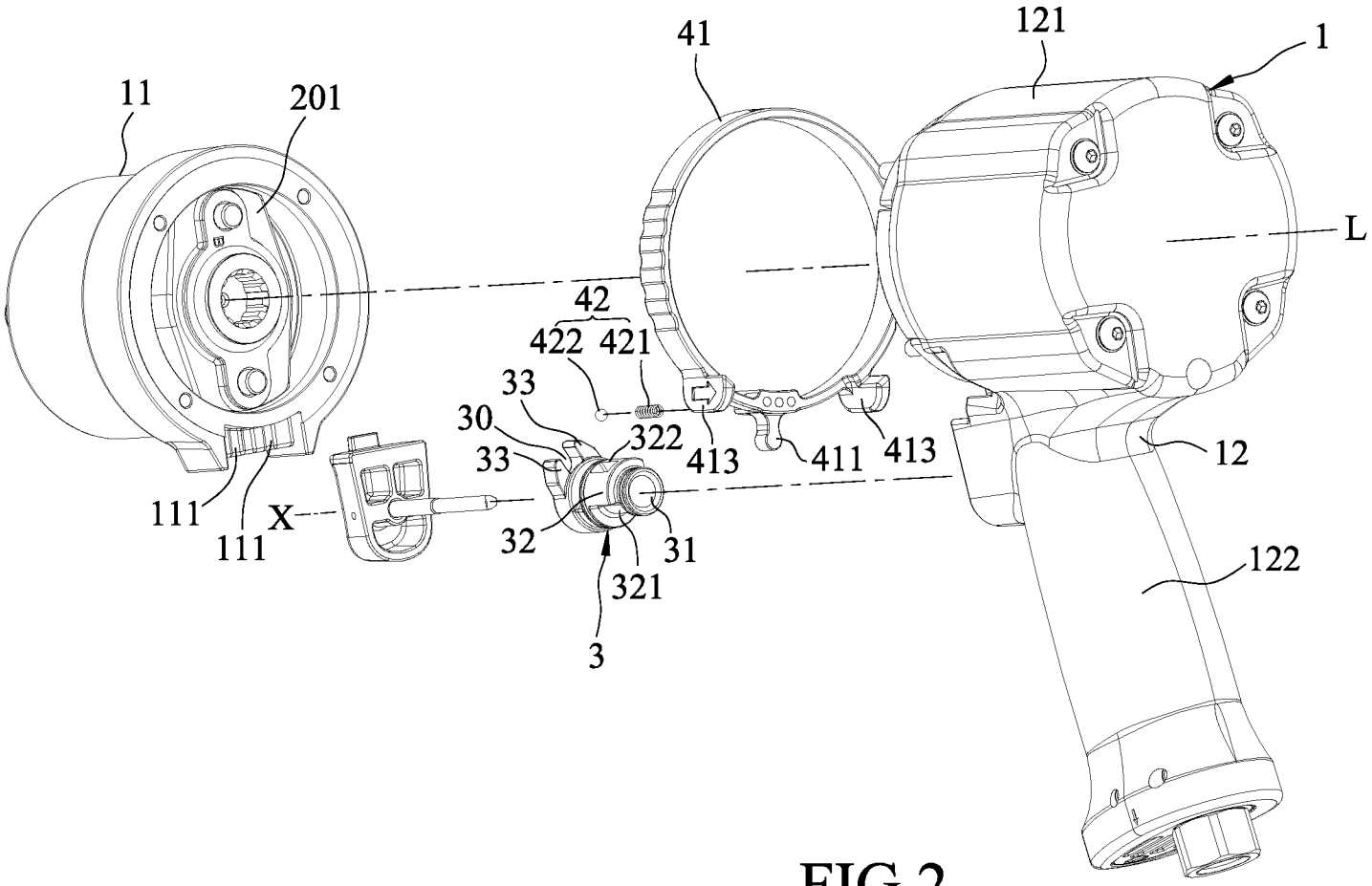
FIG. 2 is another partially exploded perspective view of the embodiment.
Figure 3:
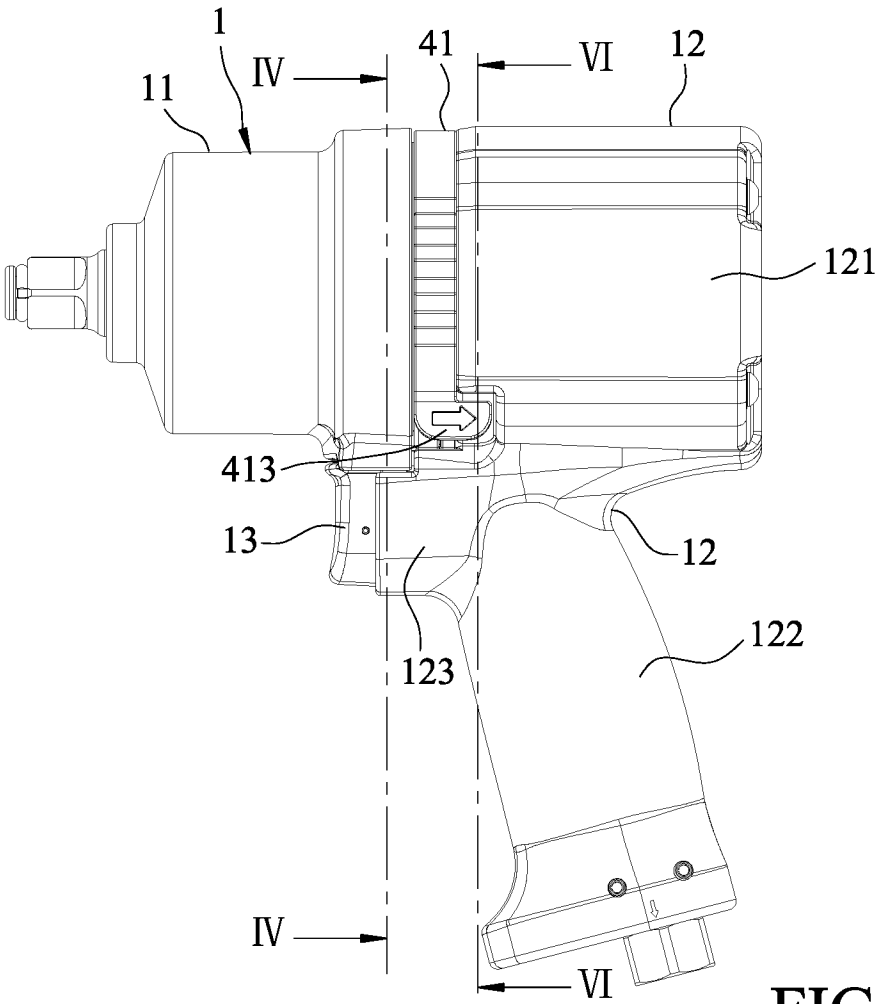
FIG. 3 is a side view of the embodiment.
Figure 4:
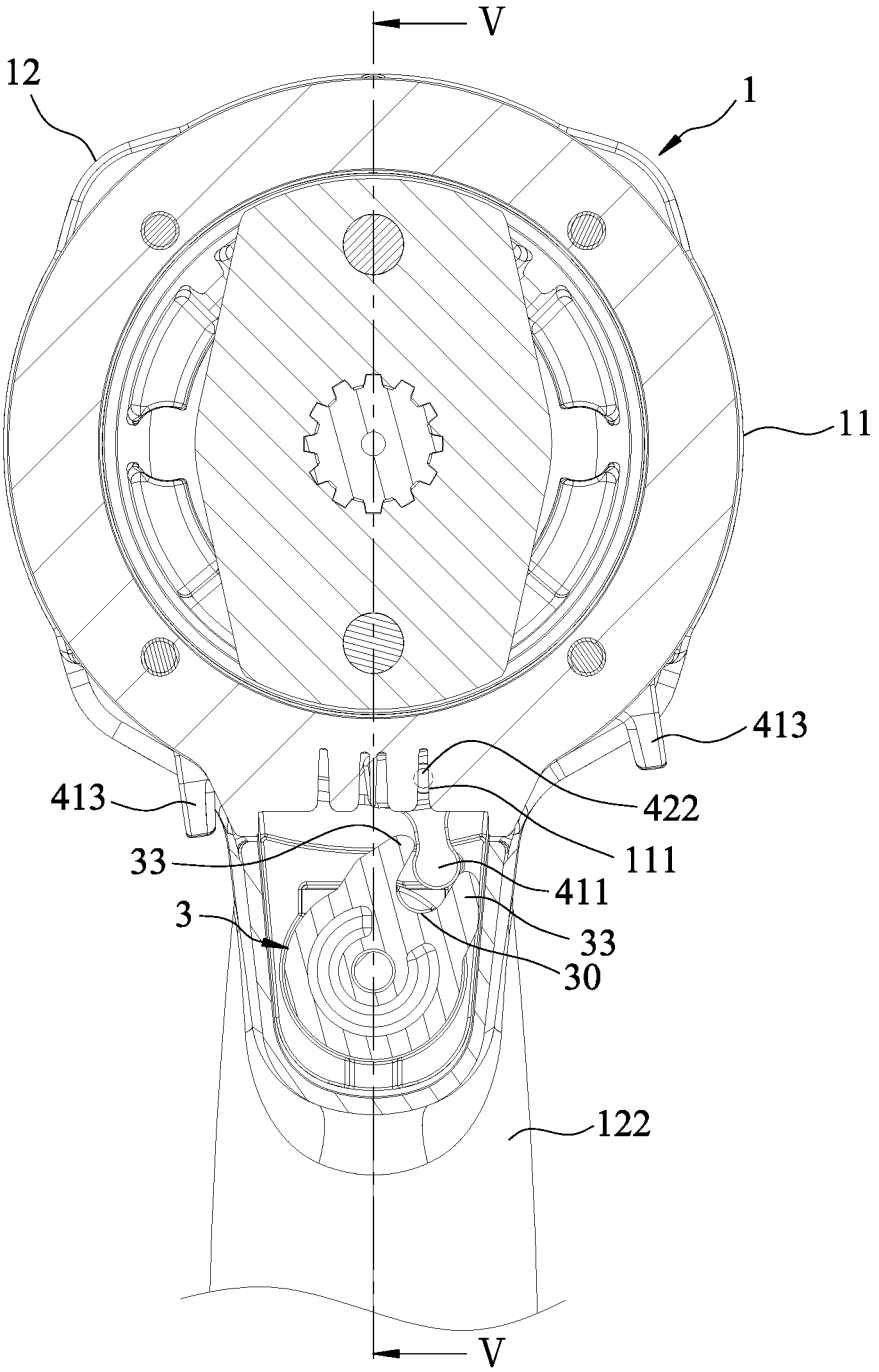
FIG. 4 is a fragmentary sectional view taken along line IV-IV in FIG. 3.
Figure 5:
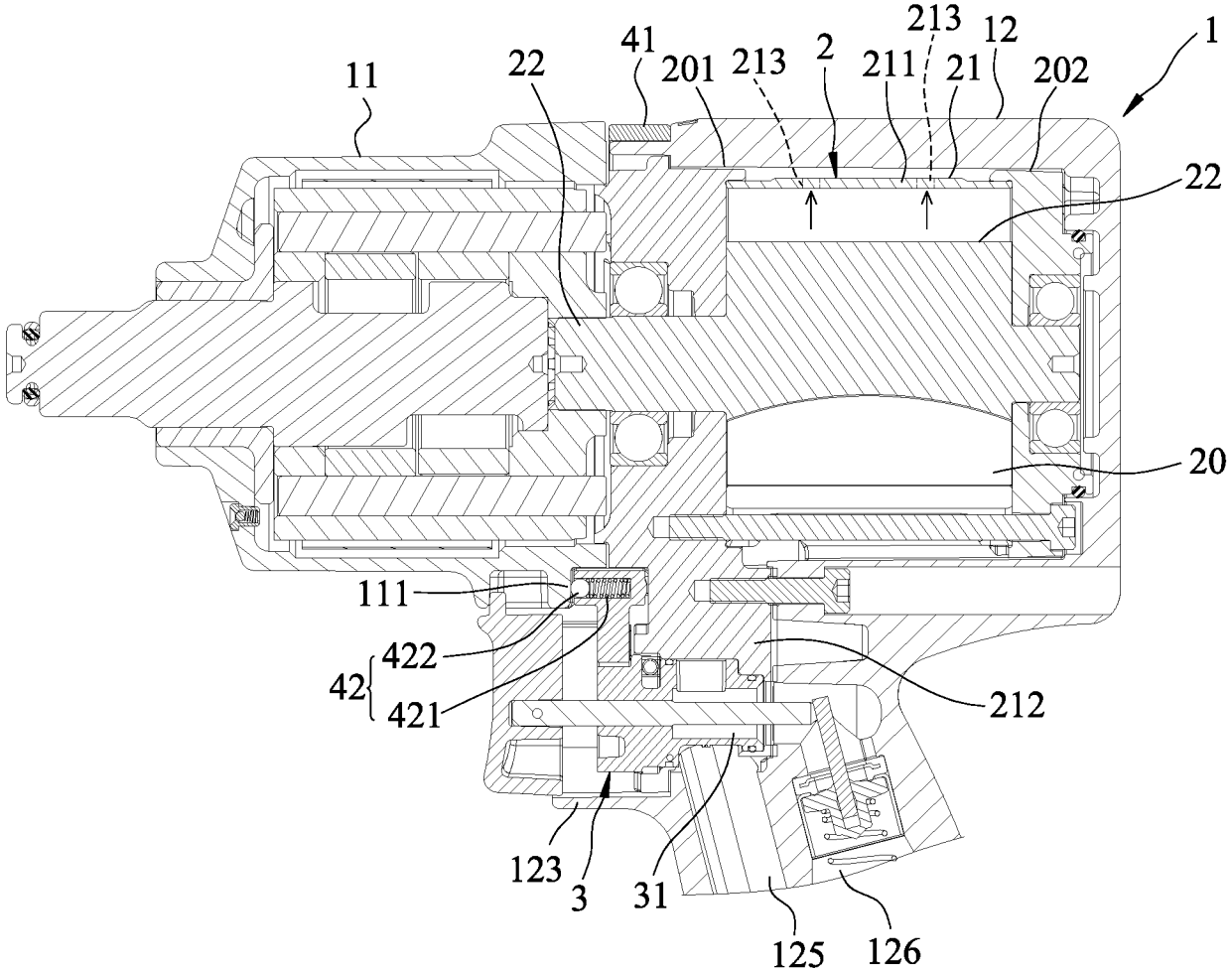
FIG. 5 is a sectional view taken along line V-V in FIG. 4.

Referring to FIGS. 1 to 3, an embodiment of a pneumatic tool according to the disclosure includes a casing unit 1, an air motor 2, a rotary valve 3 and a turning unit 4.

The casing unit 1 includes a front casing 11, a rear casing 12 coupled to the front casing 11, and a trigger 13.

The front and rear casings 11, 12 are arranged along a motor axis (L), and the front casing 11 has four positioning portions 111 that are arranged angularly about the motor axis (L). In the present embodiment, each of the positioning portions 111 is configured as a groove that faces the rear casing 12.

Referring to FIGS. 1, 4, 5 and 6, the rear casing 12 has a rear main casing 121, a handle 122 and a valve seat 123. The rear main casing 121 has a front end portion 124 that is connected to the front casing 11. The handle 122 is connected transversely to the rear main casing 121 and has an air outlet passage 125 that is connected to the external environment, and an air inlet passage 126 that is connected to a source of compressed air. The valve seat 123 is formed between the rear main casing 121 and the handle 122. The trigger 13 is mounted to the casing unit 1, extends through the valve seat 123 into the air inlet passage 126, and is operable to allow compressed air to travel from the air inlet passage 126 into the rear main casing 121. Since operational and technical details of the trigger 13 are known in the prior art and are not the focus of the disclosure, they will not be described further hereinafter.

The air motor 2 is mounted in the rear casing 12 of the casing unit 1, and includes a cylinder wall 21 and a rotor 22. The cylinder wall 21 surrounds the motor axis (L) and defines an air chamber 20. The rotor 22 is mounted in the air chamber 20 and is rotatable about the motor axis (L) relative to the cylinder wall 21.

The cylinder wall 21 has a main portion 211, front and back portions 201, 202 and an extending portion 212.

The main portion 211 is disposed in the rear main casing 121 of the rear casing 12, and surrounds the motor axis (L).

The front and back portions 201, 202 are connected to opposite ends of the main portion 211 along the motor axis (L), and cooperate with the main portion 211 to define the air chamber 20.

The main portion 211 is formed with a plurality of discharging holes 213 and first and second air ports 214, 215 that are all in spatial communication with the air chamber 20.

In the present embodiment, the extending portion 212 extends from the front portion 201 into the handle 122 of the rear casing 12 towards the air inlet passage 126 of the casing unit 1, and has first and second passages 216, 218 and first and second sub-passages 217, 217'. The first and second passages 216, 218 are in spatial communication with the air chamber 20. Specifically, the first air port 214 of the main portion 211 intercommunicates the first passage 216 with the air chamber 20, and the second air port 215 of the main portion 211 intercommunicates the second passage 218 with the air chamber 20. It should be noted that, in other embodiments, the extending portion 212 of the cylinder wall 21 may extend from the main portion 211 into the handle 122 of the rear casing 12.

Each of the first and second passages 216, 218 has an open end 2160, 2180 that is formed at an outer surface of the cylinder wall 21. Each of the first and second sub-passages 217, 217' is spatially connected to the first passage 216, is isolated from the second passage 218, and has an open end 2170, 2170' that is formed at the outer surface of the cylinder wall 21 between the open ends 2160, 2180 of the first and second passages 216, 218, and that is smaller than the open end 2160 of the first passage 216. In the present embodiment, the open ends 2170, 2170' of the first and second sub-passages 217, 217' are respectively disposed proximate to and distal from the open end 2160 of the first passage 216, and the open end 2170 of the first sub-passage 217 is larger than the open end 2170' of the second sub-passage 217'.

The rotary valve 3 is disposed in the valve seat 123 of the rear casing 12 of the casing unit 1, is mounted to the extending portion 212 of the cylinder wall 21 of the air motor 2, and is rotatable about a valve axis (X) (see FIGS. 1 and 2) relative to the extending portion 212.

The rotary valve 3 has a surrounding wall 32 and two claw portions 33. The surrounding wall 32 surrounds the valve axis (X), defines an intermediate passage 31, and is formed with a slot 321 and an opening 322. Specifically, the intermediate passage 31 spatially intercommunicates the opening 322 with the air inlet passage 126 of the casing unit 1, and the slot 321 is spaced apart from the opening 322 and the intermediate passage 31. The slot 321 is in spatial communication with the air outlet passage 125 such that air traveling through the air chamber 20 of the air motor 2 is allowed to be discharged via the slot 321 and the air outlet passage 125. Further details on the air discharging process will be described later. The claw portions 33 protrude outwardly from the surrounding wall 32, and define an engaging notch 30 therebetween.

Referring to FIGS. 6 to 12, in this embodiment, the rotary valve 3 is rotatable about the valve axis (X) among a first-end position (see FIGS. 6 and 7), a second-end position (see FIGS. 8 and 9), and first and second in-between positions (see FIGS. 10 to 12) between the first-end and second-end positions. The first-end and second-end positions are angularly offset from each other about the valve axis (X) by an angle (θ) ranging from 30 to 120 degrees.

Figure 6:
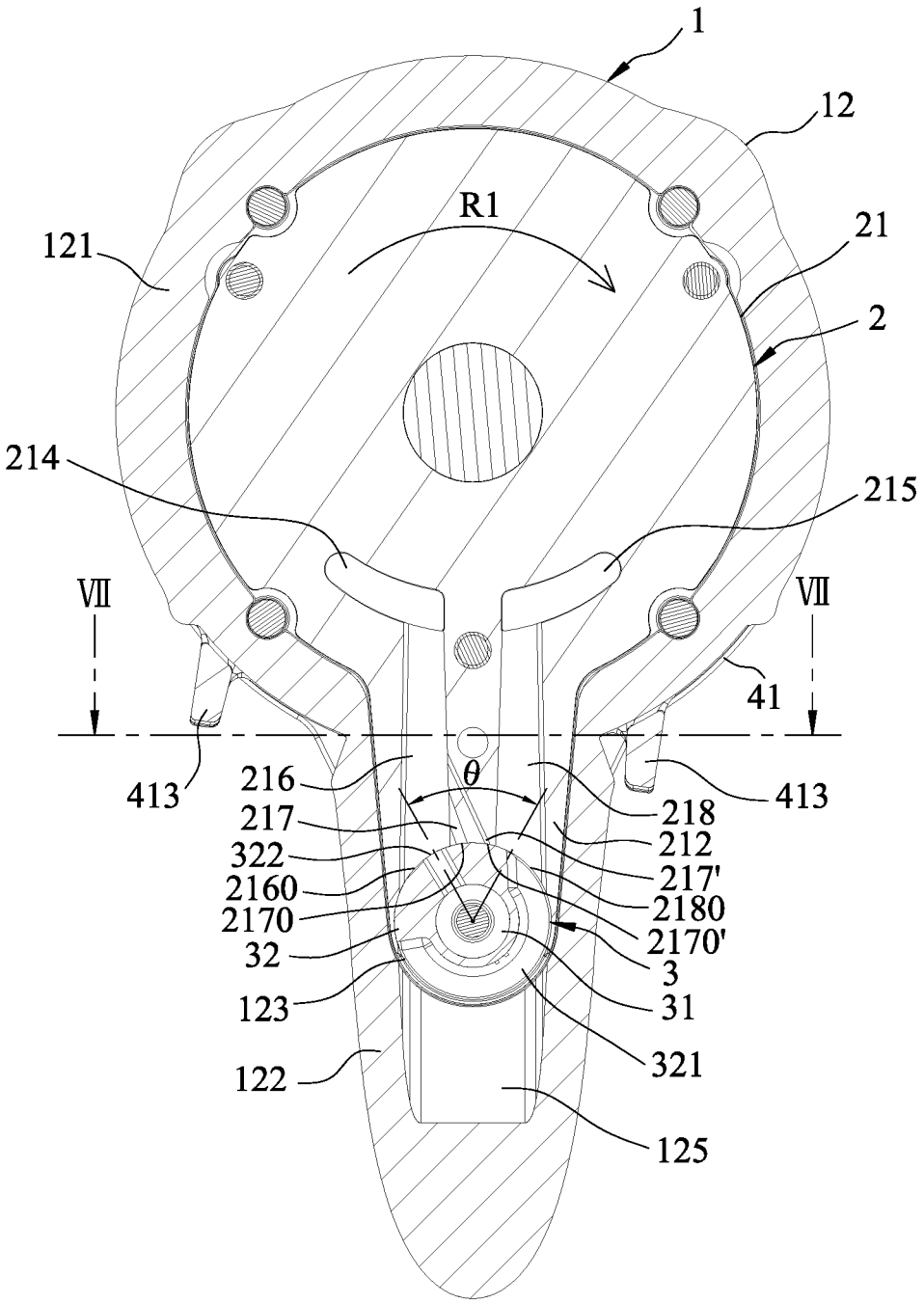
FIG. 6 is a sectional view taken along line VI-VI in FIG. 3, illustrating a rotary valve at a first-end position.
Figure 7:
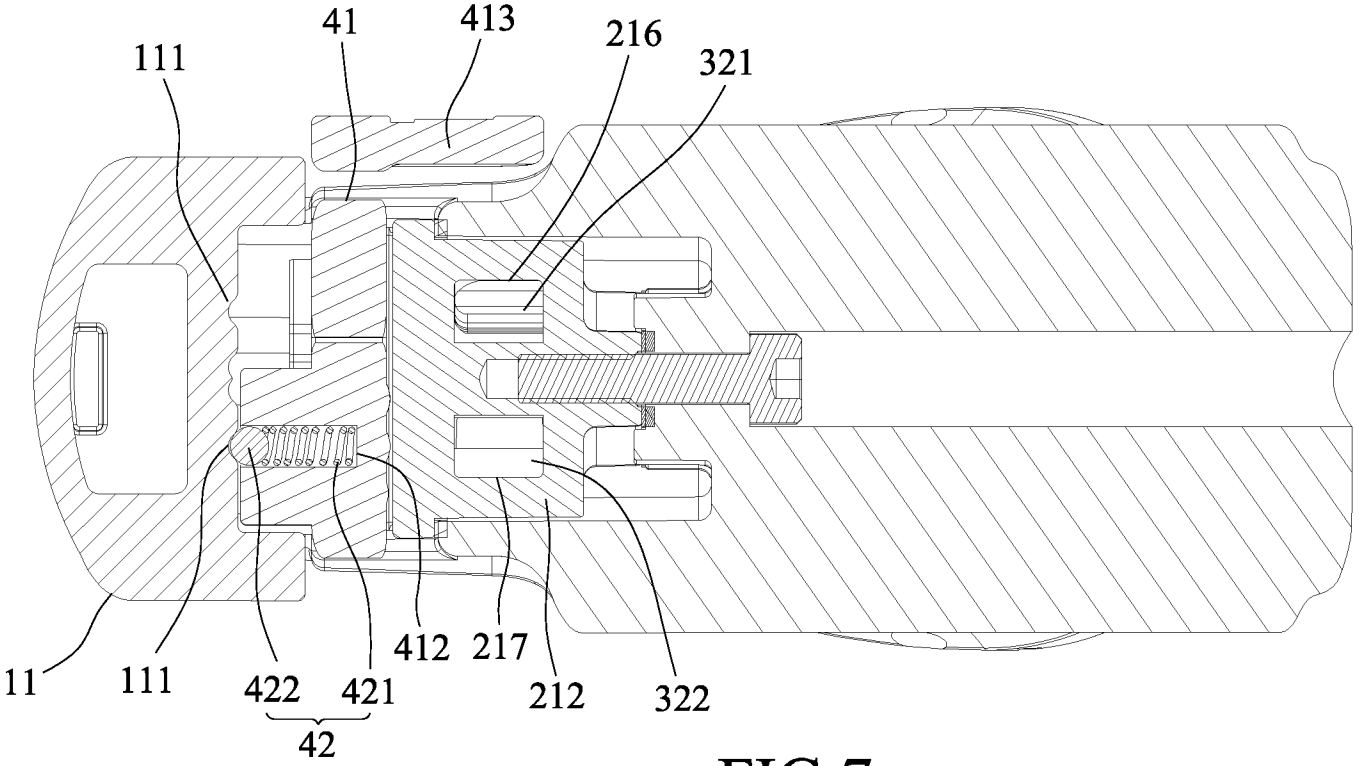
FIG. 7 is a sectional view taken along line VII-VII in FIG. 6, illustrating a positioning subunit being engaged with a corresponding positioning portion when the rotary valve is at the first-end position.

When the rotary valve 3 is at the first-end position as shown in FIGS. 6 and 7, the opening 322 thereof is in spatial communication with the first passage 216 and the first air port 214 of the air motor 2, so that the compressed air traveling through the air inlet passage 126 of the casing unit 1, the intermediate passage 31 of the rotary valve 3, and the opening 322 of the rotary valve 3 is allowed to flow through the first passage 216 and the first air port 214 of the air motor 2, and to flow into the air chamber 20 of the air motor 2 for driving operation of the air motor 2. Specifically, the rotor 22 of the air motor 2 rotates in a first direction (R1) (see FIG. 6) during the operation of the air motor 2.

In addition, since the slot 321 spatially intercommunicates the air outlet passage 125 with the second passage 218 and the second air port 215 of the air motor 2, the air traveling through the air chamber 20 is allowed to pass through the second air port 215, the second passage 218, the slot 321 and the air outlet passage 125 to be discharged to the external environment.

Figure 8:
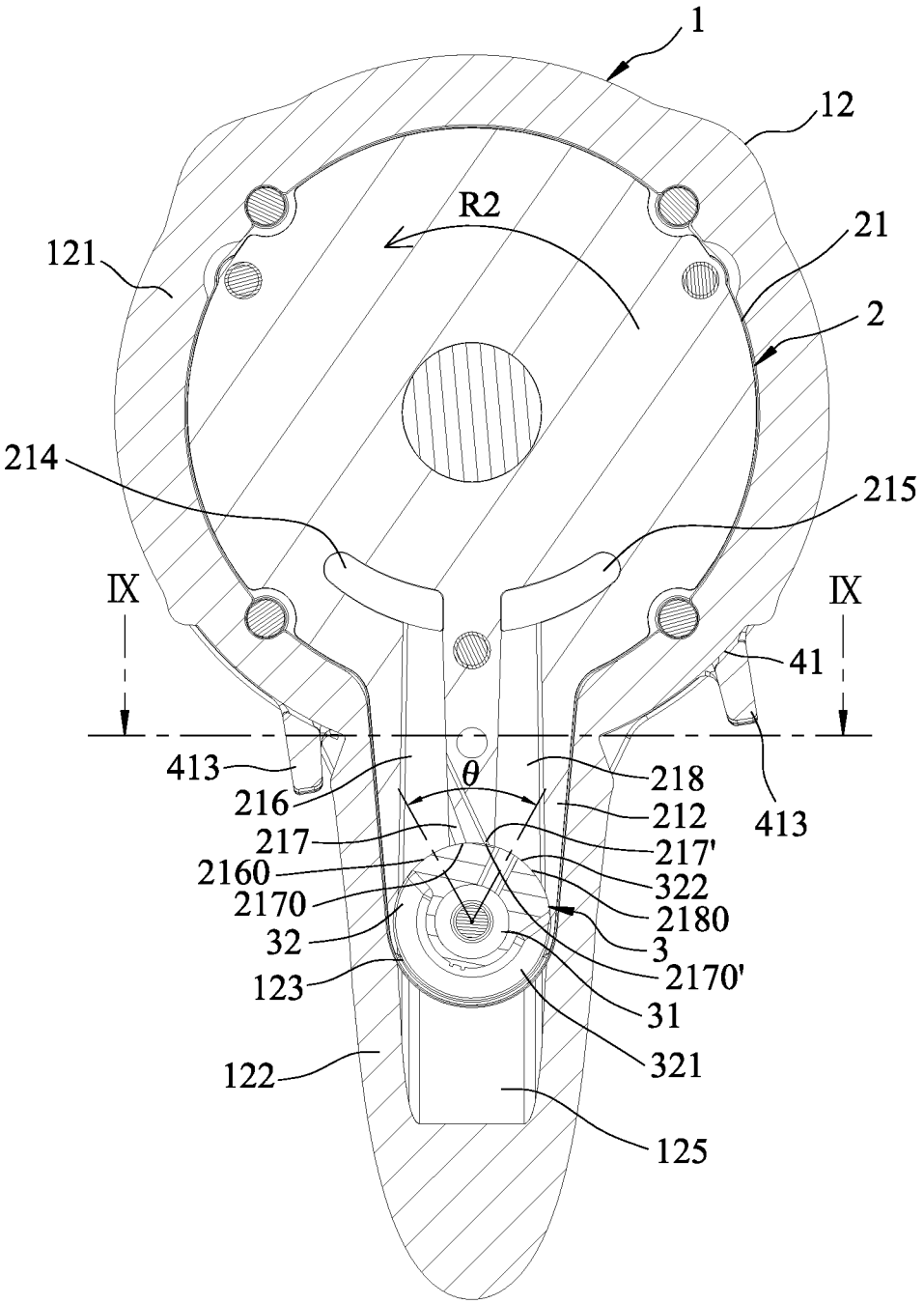
FIG. 8 is a view similar to FIG. 6, but illustrating the rotary valve at a second-end position.
Figure 9:
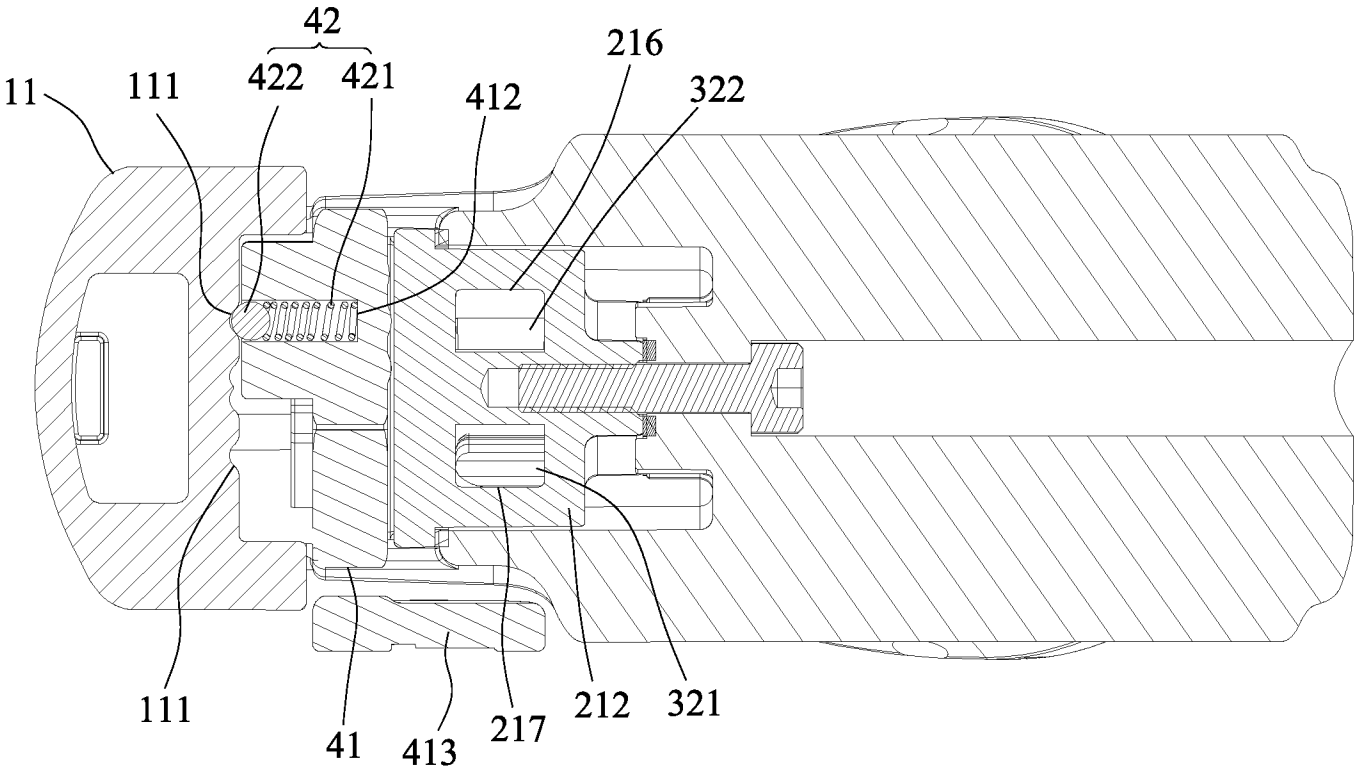
FIG. 9 is a sectional view taken along line IX-IX in FIG. 8, illustrating the positioning subunit being engaged with another corresponding positioning portion when the rotary valve is at the second-end position.

When the rotary valve 3 is at the second-end position as shown in FIGS. 8 and 9, the opening 322 is in spatial communication with the second passage 218 and the second air port 215 of the air motor 2, so that the compressed air is allowed to drive the operation of the air motor 2 in a similar manner as mentioned above. However, in this case, the compressed air flows into the air chamber 20 via the second passage 218 and the second air port 215, and the rotor 22 of the air motor rotates in a second direction (R2) (see FIG. 8) that is opposite to the first direction (R1).

In addition, the slot 321 now spatially intercommunicates the air outlet passage 125 with the first passage 216 and the first air port 214 of the air motor 2, so that the air traveling through the air chamber 20 is allowed to pass through the first air port 214 and the first passage 216 to be discharged into the external environment in a similar manner as mentioned above.

Figure 10:
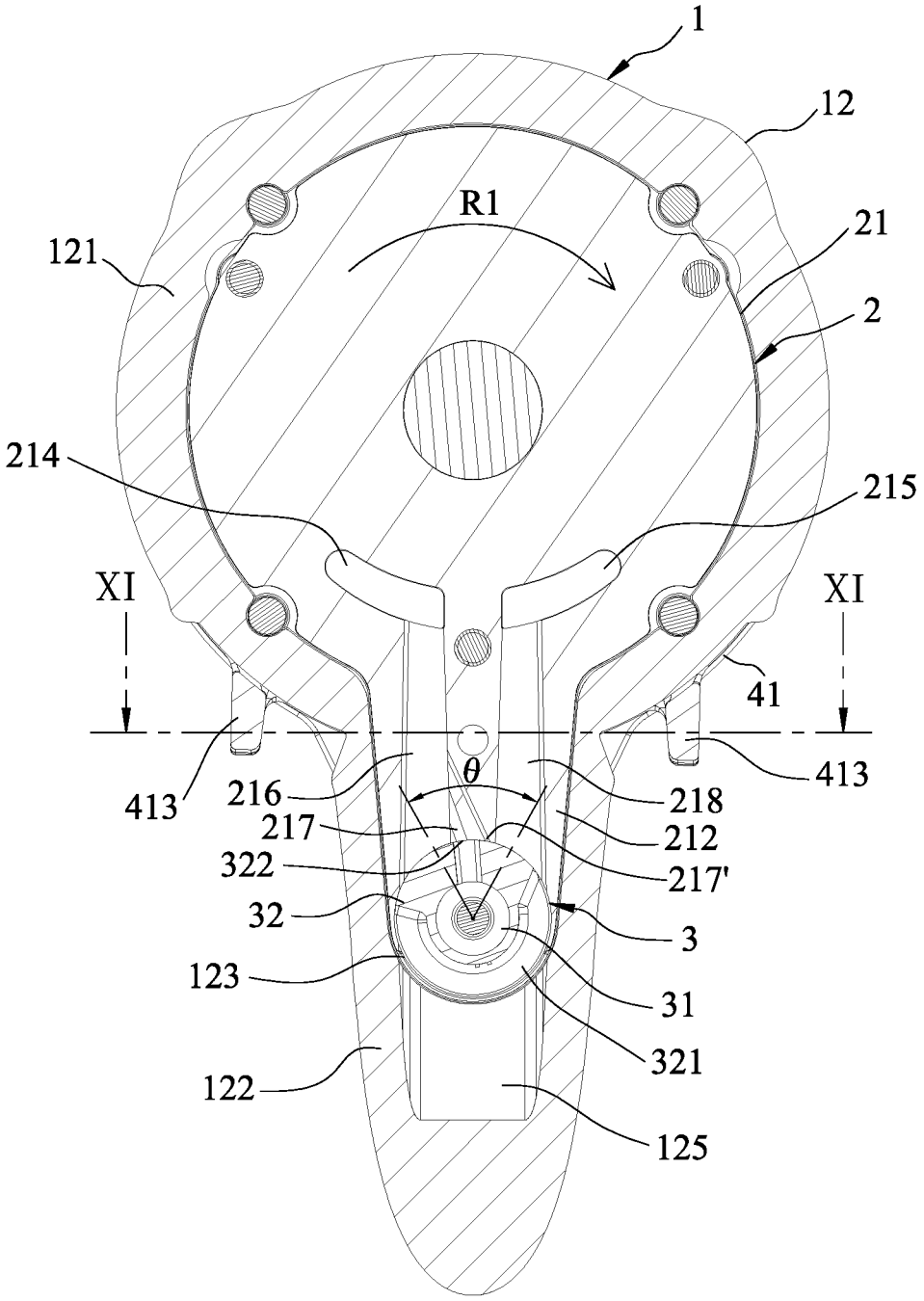
FIG. 10 is another view similar to FIG. 6, but illustrating the rotary valve in a first in-between position.
Figure 11:
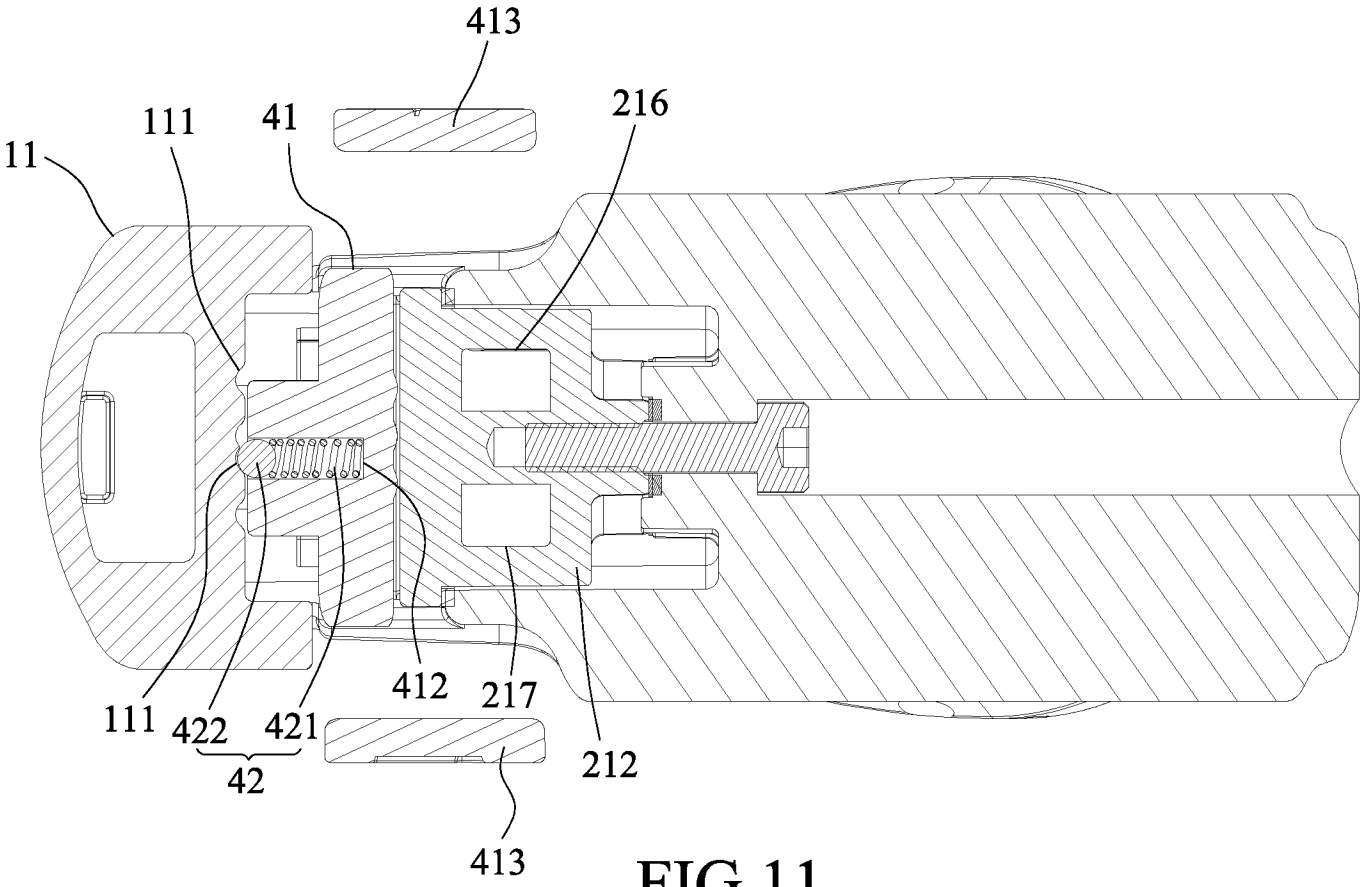
FIG. 11 is a sectional view taken along line XI-XI of FIG. 10, illustrating the positioning subunit being engaged with yet another corresponding positioning portion when the rotary valve is at the first in-between position.

When the rotary valve 3 is at the first in-between position as shown in FIGS. 10 and 11, the opening 322 is in spatial communication with the first sub-passage 217 and the first air port 214. Since the open end 2170 of the first sub-passage 217 is smaller than the open end 2160 of the first passage 216, the flow rate of the compressed air is reduced, that is, the air motor 2 is now driven by relatively less compressed air, thereby producing a power output lower than that when the rotary valve 3 is at the first-end position.

Figure 12:
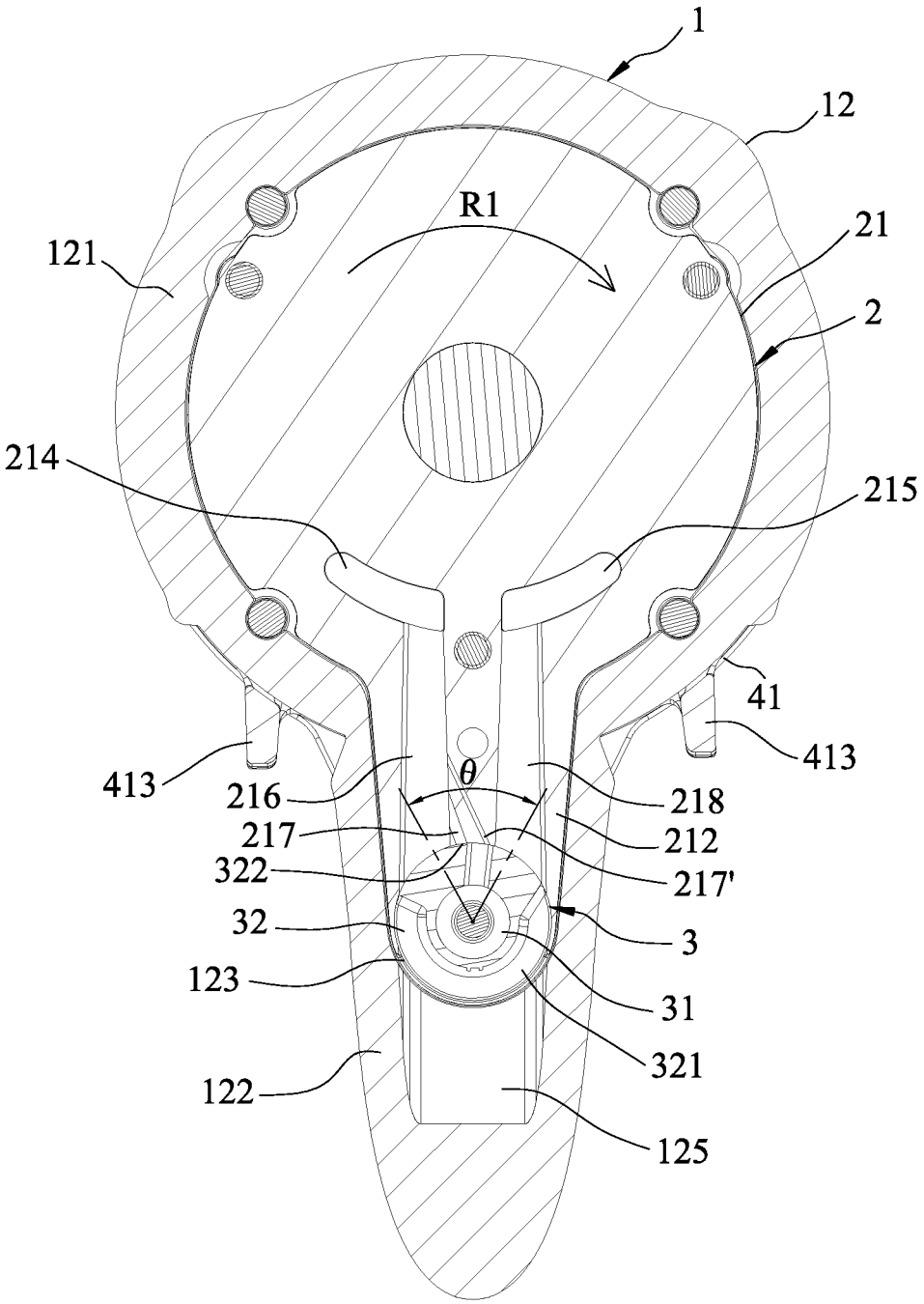
FIG. 12 is a view similar to FIG. 10, but illustrating the rotary valve at a second in-between position.

In a similar manner, when the rotary valve 3 is at the second in-between position as shown in FIG. 12, the opening 322 is in spatial communication with the second sub-passage 217' and the first air port 214. Since the open end 2170' of the second sub-passage 217' is smaller than the open end 2170 of the first sub-passage 217, the flow rate of the compressed air is further reduced, and the air motor 2 is now driven by even less compressed air, thereby producing a power output lower than that when the rotary valve 3 is at the first in-between position. In cases where lower power output is required, for example, driving a screw into wood, damages resulting from excessive power output can be prevented.

It should be noted that, the number of the sub-passages is not limited to two. In other variations of the present embodiment, there may be three, four or more sub-passages, and each of such sub-passages is not limited to be connected to the first passage 216. That is, each of the sub-passages may be in spatial communication with the second passage 218 and be isolated from the first passage 216, depending on practical needs.

Referring again to FIGS. 1, 4, 5 and 6, the turning unit 4 is movably mounted to the casing unit 1, and includes a ring member 41 and a positioning subunit 42.

The ring member 41 of the turning unit 4 surrounds and is rotatably mounted to the casing unit 1. Specifically, the ring member 41 surrounds the front end portion 124 of the rear casing 12, is disposed between the front and rear casings 11, 12 of the casing unit 1, is connected to the rotary valve 3, and is rotatable relative to the casing unit 1.

In this embodiment, the ring member 41 has an engaging portion 411, a blind hole 412 and two controlling portions 413. The engaging portion 411 movably engages the engaging notch 30 of the rotary valve 3, such that rotation of the ring member 41 relative to the casing unit 1 drives the rotary valve 3 to rotate about the valve axis (X) relative to the air motor 2. The blind hole 412 extends substantially in a direction of the valve axis (X), and has an open end that faces the front casing 11 of the casing unit 1. The controlling portions 413 are angularly spaced apart from each other.

The positioning subunit 42 of the turning unit 4 is mounted to the ring member 41, and includes a ball member 422 and a resilient member 421. The ball member 422 is disposed at the open end of the blind hole 412 of the ring member 41. The resilient member 421 is disposed in the blind hole 412 for biasing the ball member 422 to detachably engage one of the positioning portions 111 of the front casing 11 of the casing unit 1 for positioning the rotary valve 3 at a respective one of the first-end position, the second-end position, and the first and second in-between positions.

It should be noted that, in other variations of the present embodiment, the number of the positioning portions 111 may be five, six or more, etc., depending on the number of the in-between positions.

Referring to FIGS. 4, 6 and 7 or FIGS. 4, 8 and 9, prior to an operation of the pneumatic tool, to achieve a maximum power output of the air motor 2 in one of the first and second directions (R1, R2) (see FIGS. 6 and 8), a user can use only one hand to rotate the ring member 41 of the turning unit 4 by pushing a corresponding one of the controlling portions 413 thereof, such that the rotation of the ring member 41 drives the rotary valve 3 to convert to a corresponding one of the first-end and second-end positions. At the same time, the ball member 422 of the positioning subunit 42 of the turning unit 4 engages a corresponding one of the two outermost positioning portions 111 of the casing unit 1 so that the rotary valve 3 is secured in its current position.

Next, when the user pulls the trigger 13 of the casing unit 1, the compressed air is allowed to enter the air chamber 20 of the air motor 2 by traveling through one of the above-mentioned routes, that is, the air traveling routes when the rotary valve 3 is in the first-end and second-end positions. Once the compressed air enters the air chamber 20, the rotor 22 is driven to rotate in the one of the first and second directions (R1, R2), and the pneumatic tool is ready for use.

To use the pneumatic tool with a relatively lower power output, the user rotates the ring member 41 in a similar manner as mentioned, and drives the rotary valve 3 to one of the first and second in-between positions. At this time, the ball member 422 of the positioning subunit 42 of the turning unit 4 engages a corresponding one of the middle two of the positioning portions 111 so that the rotary valve 3 is secured in position.

Next, when the user pulls the trigger 13 of the casing unit 1, the compressed air is allowed to enter the air chamber 20 of the air motor 2 by traveling through the abovementioned route when the rotary valve 3 is in the one of the first and second in-between positions. Once the compressed air enters the air chamber 20, the rotor 22 is driven to rotate in the first direction (R1). During this time, since the open ends 2170, 2170' of the first and second sub-passages 217, 217' are relatively smaller, the flow rate of the compressed air is reduced so that the air motor 2 is now driven by relatively less compressed air and produces a lower power output.

After the compressed air drives the rotor 22 to rotate, a portion of the air will be discharged out of the air chamber 20 via the discharging holes 213 during the operation of the air motor 2. If the rotor 22 rotates in the first direction (R1), another portion of the air will pass through the second passage 218 (or if the rotor 22 rotates in the second direction (R2), the another portion of the air will pass through the first passage 216), and follow the abovementioned air routes to be discharged into the external environment. Further details of the air discharging process is known in the prior art and will be not be described hereinafter.

In summary, the pneumatic tool according to the disclosure has advantages as follows.

By virtue of the first and second sub-passages 217, 217' of the air motor 2, and the engagement between the positioning subunit 42 of the turning unit 4 and any one of the positioning portions 111 of the casing unit 1, the rotary valve 3 is able to convert among different positions, thereby controlling the flow rate of compressed air. Thus, the user is able to adjust not only the direction but the magnitude of the power output of the air motor 2 for different uses and purposes.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A pneumatic tool comprising:

a casing unit having an air inlet passage;

an air motor mounted in said casing unit, and including a cylinder wall that surrounds a motor axis and that defines an air chamber, said cylinder wall having first and second passages that are in spatial communication with said air chamber, each of said first and second passages having an open end formed at an outer surface of said cylinder wall, and at least one sub-passage that has a first open end directly and spatially connected to one of said first and second passages and isolated from the other one of said first and second passages, and a second open end formed at said outer surface of said cylinder wall between said open ends of said first and second passages, said second open end of said at least one sub-passage being smaller than said open end of said one of said first and second passages;

a rotary valve mounted to said air motor and rotatable about a valve axis, said rotary valve having an opening and an intermediate passage that intercommunicates said opening with said air inlet passage of said casing unit; and a turning unit movably mounted to said casing unit and connected to said rotary valve, such that movement of said turning unit relative to said casing unit drives said rotary valve to rotate about the valve axis relative to said air motor among a first-end position, where said opening is in spatial communication with said first passage, so that air traveling through said air inlet passage of said casing unit is allowed to flow into said air chamber of said air motor via said first passage for driving operation of said air motor, a second-end position, where said opening is in spatial communication with said second passage, so that the air traveling through said air inlet passage is allowed to flow into said air chamber via said second passage for driving operation of said air motor, and at least one in-between position, where said opening is in spatial communication with said at least one sub-passage, so that the air traveling through said air inlet passage is allowed to flow into said air chamber via said at least one sub-passage at a flow rate different from those when said rotary valve is at the first-end position and the second-end position for driving operation of said air motor.

2. The pneumatic tool as claimed in claim 1, wherein said at least one sub-passage of said cylinder wall of said air motor includes first and second sub-passages that are in spatial communication with said first passage.

3. The pneumatic tool as claimed in claim 2, wherein:

said open ends of said first and second sub-passages are respectively disposed proximate to and distal from said open end of said first passage; and said second open end of said first sub-passage is larger than said open end of said second sub-passage.

4. The pneumatic tool as claimed in claim 1, wherein said cylinder wall further has:

a main portion surrounding the motor axis;

front and back portions connected to opposite ends of said main portion along the motor axis, and cooperating with said main portion to define said air chamber; and an extending portion extending from one of said main portion and front portion toward said air inlet passage of said casing unit, and having said first and second passages and said at least one sub-passage, said main portion being formed with a first air port that intercommunicates said first passage with said air chamber, and a second air port that intercommunicates said second passage with said air chamber.

5. The pneumatic tool as claimed in claim 4, wherein:

said rotary valve further has a surrounding wall that surrounds the valve axis, that defines said intermediate passage, and that is formed with said opening, and two claw portions that protrude outwardly from said surrounding wall and that define an engaging notch therebetween; and said turning unit has an engaging portion that movably engages said engaging notch for driving rotation of said rotary valve about the valve axis.

6. The pneumatic tool as claimed in claim 5, wherein:

said casing unit further has an air outlet passage; and said surrounding wall of said rotary valve is further formed with a slot that is in spatial communication with said air outlet passage such that air traveling through said air chamber of said air motor is allowed to be discharged through said slot and said air outlet passage.

7. The pneumatic tool as claimed in claim 5, wherein said turning unit includes a ring member that surrounds and is rotatably mounted to said casing unit, and that has said engaging portion.

8. The pneumatic tool as claimed in claim 7, wherein:

said casing unit further has a plurality of positioning portions; and said turning unit further includes a positioning subunit that is mounted to said ring member and that detachably engages one of said positioning portions for positioning said rotary valve at a respective one of the first-end position, the second-end position, and the at least one in-between position.

9. The pneumatic tool as claimed in claim 8, wherein:

each of said positioning portions of said casing unit is configured as a groove;

said ring member further has a blind hole having an open end; and said positioning subunit includes a ball member disposed at said open end of said blind hole of said ring member, and a resilient member disposed in said blind hole for biasing said ball member to detachably engage the one of said positioning portions.

10. The pneumatic tool as claimed in claim 8, wherein said casing unit includes a front casing and a rear casing that are arranged along the motor axis, said front casing having said positioning portions that are arranged angularly about the motor axis, said rear casing being coupled to said front casing and having said air inlet passage, said air motor being mounted in said rear casing.

* * * * *